US012729089B2

(12) United States Patent
Fukuda et al.

(10) Patent No.: US 12,729,089 B2
(45) Date of Patent: Sep. 8, 2026

(54) STACKING APPARATUS AND STACKING SYSTEM

(71) Applicant: Murata Manufacturing Co., Ltd., Kyoto-fu (JP)

(72) Inventors: Kouhei Fukuda, Nagaokakyo (JP); Arata Suzuki, Nagaokakyo (JP); Kodai Murata, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 50 days.

(21) Appl. No.: 18/414,028

(22) Filed: Jan. 16, 2024

(65) Prior Publication Data

US 2024/0150148 A1 May 9, 2024

Related U.S. Application Data

(63) Continuation of application No. PCT/JP2023/003701, filed on Feb. 6, 2023.

(30) Foreign Application Priority Data

Jun. 15, 2022 (JP) ..... 2022-096220

(51) Int. Cl.
*B65H 31/10* (2006.01)
*B65H 31/34* (2006.01)

(52) U.S. Cl.
CPC ..... *B65H 31/10* (2013.01); *B65H 31/34* (2013.01); *B65H 2301/4212* (2013.01); *B65H 2801/72* (2013.01)

(58) Field of Classification Search
CPC ..... B65H 31/10; B65H 31/34; B65H 2301/4212; B65H 2801/72;
(Continued)

(56) References Cited

U.S. PATENT DOCUMENTS 9,461,330 B2 * 10/2016 Watanabe ..... H01M 10/0468

FOREIGN PATENT DOCUMENTS

CN 112219304 A 1/2021
JP H02-027769 U 2/1990
(Continued)

OTHER PUBLICATIONS

Machine translation for KR101959082B1 (Year: 2019).*
(Continued)

*Primary Examiner* — Scott A Browne
*Assistant Examiner* — Lidia Kwiatkowska
(74) *Attorney, Agent, or Firm* — Studebaker Brackett PLLC

(57) ABSTRACT

A stacking apparatus includes a stacking stage, a correction mechanism, a driving mechanism, and a linear-motion mechanism. The stacking stage has a stacking surface, on which objects are to be stacked in layers. The correction mechanism moves the stacking stage in a direction parallel to the stacking surface. The driving mechanism moves the stacking stage in a direction perpendicular to the stacking surface. The linear-motion mechanism connects the stacking stage and the correction mechanism, gives freedom of movement in the direction perpendicular to the stacking surface and constrains movement in the direction parallel to the stacking surface. The driving mechanism includes a main body part that does not overlap the stacking stage when viewed in the direction perpendicular to the stacking surface, and an arm part that extends from the main body part and between the stacking stage and the correction mechanism and supports the stacking stage.

20 Claims, 5 Drawing Sheets

(58) Field of Classification Search
CPC ..... B65H 2405/3521; B65H 2555/13; B65H 5/08; B65H 31/24; B65H 31/3063; B65H 39/075; Y02E 60/10; Y02P 70/50; G12B 5/00
See application file for complete search history.

(56) References Cited

FOREIGN PATENT DOCUMENTS

| | | | | | |
|---|---|---|---|---|---|
| JP | H02-238507 | A | | 9/1990 | |
| JP | H03-097560 | A | | 4/1991 | |
| JP | H05-070255 | A | | 3/1993 | |
| JP | 2000-147044 | A | | 5/2000 | |
| JP | 2003-028973 | A | | 1/2003 | |
| JP | 2017004615 | A | * | 1/2017 | |
| JP | 2017-047679 | A | | 3/2017 | |
| KR | 101959082 | B1 | * | 3/2019 | ..... H01M 10/0404 |
| WO | 2007/010971 | A1 | | 1/2007 | |
| WO | WO-2019239863 | A1 | * | 12/2019 | ..... H01M 10/0404 |
| WO | 2020/050537 | A1 | | 3/2020 | |
| WO | 2021/220770 | A1 | | 11/2021 | |
| WO | 2021/220771 | A1 | | 11/2021 | |

OTHER PUBLICATIONS

Machine translation for WO2019239863A1 (Year: 2019).*
Machine translation for JP2017004615A (Year: 2017).*
International Search Report issued in PCT/JP2023/003701; mailed Mar. 28, 2023.

* cited by examiner

STACKING APPARATUS AND STACKING SYSTEM

CROSS-REFERENCE TO RELATED APPLICATIONS

This application claims benefit of priority to International Patent Application No. PCT/JP2023/003701, filed Feb. 6, 2023, and to Japanese Patent Application No. 2022-096220, filed Jun. 15, 2022, the entire contents of each are incorporated herein by reference.

BACKGROUND

Technical Field

The present disclosure relates to a stacking apparatus that stacks objects in layers. The present disclosure also relates to a stacking system.

Background Art

Stacking apparatuses each designed to stack objects in layers on a stacking stage are known in the art.

One of such stacking apparatuses is a shaping apparatus disclosed in Japanese Unexamined Patent Application Publication No. 2017-47679. The shaping apparatus includes a transfer member that transfers material layers. The shaping apparatus stacks the material layers on a stacking stage. The shaping apparatus in Japanese Unexamined Patent Application Publication No. 2017-47679 determines the position of each material layer on the transfer member and measures the degree of misalignment of the material layers. The shaping apparatus includes a stage correction mechanism disposed vertically below the stacking stage and designed to correct the position of the stacking stage on the basis of the determined degree of misalignment.

The shaping apparatus in Japanese Unexamined Patent Application Publication No. 2017-47679 also includes a stage up-and-down mechanism disposed vertically below the stage correction mechanism. The stage up-and-down mechanism is configured to cause the stacking stage to ascend and descend together with the stage correction mechanism so that the position of the stacking stage in the vertical direction can be adjusted.

SUMMARY

When the stacking stage is caused to ascend or descend, the stage correction mechanism ascends and descends in tandem with the stacking stage. This configuration requires greater driving force than would be necessary for a mechanism that causes only the stacking stage to ascend and descend. For this reason, the stage up-and-down mechanism of the shaping mechanism in Japanese Unexamined Patent Application Publication No. 2017-47679 is large in size.

The present disclosure therefore provides a stacking apparatus including a compact driving mechanism that moves a stacking stage in a direction perpendicular to a stacking surface. The present disclosure also provides a stacking system including such a stacking apparatus.

A stacking apparatus according to the present embodiment includes a stacking stage, a correction mechanism, a driving mechanism, and a linear-motion mechanism. The stacking stage has a stacking surface on which a plurality of objects are to be stacked in layers. The correction mechanism is configured to move the stacking stage in a direction parallel to the stacking surface. The driving mechanism is configured to move the stacking stage in a direction perpendicular to the stacking surface. The linear-motion mechanism connects the stacking stage and the correction mechanism to each other. The linear-motion mechanism gives freedom of movement in the direction perpendicular to the stacking surface and constrains movement in the direction parallel to the stacking surface. The driving mechanism includes a main body part and the arm part. The main body part does not overlap the stacking stage when viewed in the direction perpendicular to the stacking surface. The arm part extends from the main body part and between the stacking stage and the correction mechanism and supports the stacking stage. The arm part is capable of movement in the direction perpendicular to the stacking surface.

A stacking system according to the present disclosure includes a plurality of feed mechanisms and a movement mechanism. The plurality of feed mechanisms are provided for a plurality of feed points. Each of the plurality of feed mechanisms is configured to feed the plurality of objects to a corresponding one of the plurality of feed points. The movement mechanism includes a stator and a mover that constitute a linear motor. The stator defines a predetermined track. The mover is capable of movement between the plurality of feed points along the predetermined tack. The mover includes the stacking apparatus.

The stacking apparatus according to the present embodiment has the following features. The main body part of the driving mechanism does not overlap the stacking stage when viewed in the direction perpendicular to the stacking surface of the stacking stage, and the arm part of the driving mechanism extends from the main body part and between the stacking stage and the correction mechanism and supports the stacking stage and is capable of movement in the direction perpendicular to the stacking surface. Thus, the stacking stage can be moved independently of the correction mechanism in the direction perpendicular to the stacking surface while the arm part is moved in the direction perpendicular to the stacking surface. The driving mechanism is thus more compact in size than would be the case if the driving mechanism is configured to drive the stacking stage and the correction mechanism at all once.

The stacking system according to the present disclosure includes: the feed mechanisms configured to feed objects; and the movement mechanism. The mover included in the movement mechanism includes the stacking apparatus. The mover can thus be compact in size. Accordingly, the stacking system can be compact in size.

DETAILED DESCRIPTION

Hereinafter, features of the present disclosure will be specifically described by way of embodiments.

Figure 1:
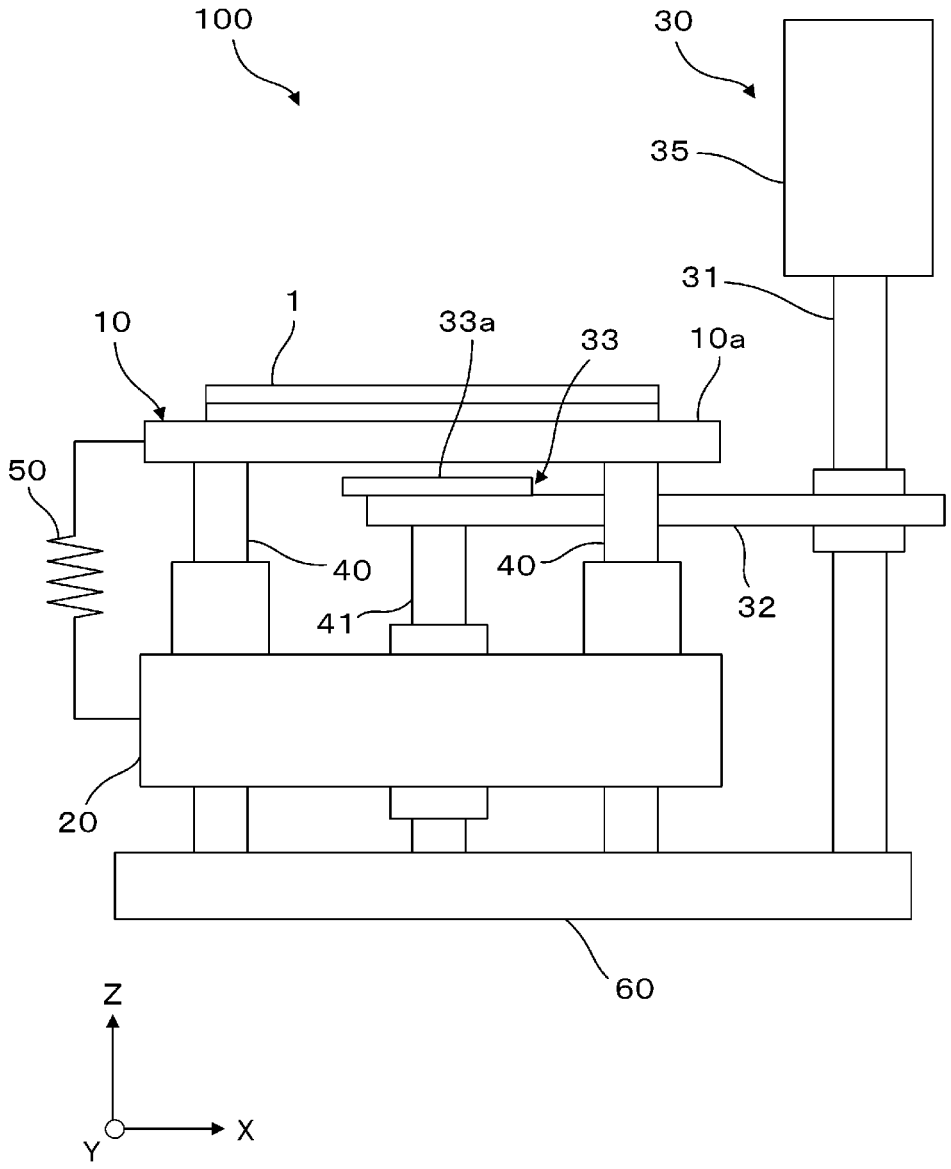
FIG. 1 is a schematic side view of the structure of a stacking apparatus according to an embodiment.

FIG. 1 is a schematic side view of the structure of a stacking apparatus according to an embodiment. The stacking apparatus is herein denoted by 100. The stacking apparatus 100 according to an embodiment includes a stacking stage 10, a correction mechanism 20, a driving mechanism 30, and a linear-motion mechanism 40.

The stacking stage 10 has a stacking surface 10*a*, on which objects 1 are to be stacked in layers. The stacking stage 10 is made of, for example, a ceramic material or a metal plate and is preferably made of aluminum, which is rigid and light in weight. The stacking surface 10*a* may have any shape. For example, the stacking surface 10*a* is rectangular when viewed in a direction perpendicular to the stacking surface 10*a*. Referring to FIG. 1, the Z axis is perpendicular to the stacking surface 10*a*, and the X axis and the Y axis are parallel to the stacking surface 10*a*. The direction perpendicular to the stacking surface 10*a* of the stacking stage 10 may be hereinafter also referred to as Z axis direction. As illustrated in FIG. 1, the stacking surface 10*a* extends in a horizontal direction, in which case the direction perpendicular to the stacking surface 10*a* is a vertical direction. The three axes (the X axis, the Y axis, and the Z axis) are perpendicular to each other.

The objects 1 are to be stacked in layers on the stacking stage 10. For example, the objects 1 are in the form of sheets. However, it is not required that the objects 1 be in sheet form. The objects 1 are sequentially stacked on top of one another on the stacking surface 10*a* of the stacking stage 10. For example, the objects 1 are held by a holding part when being stacked in layers on the stacking stage 10. However, it is not required that such a holding part be included in the stacking apparatus 100.

Figure 2:
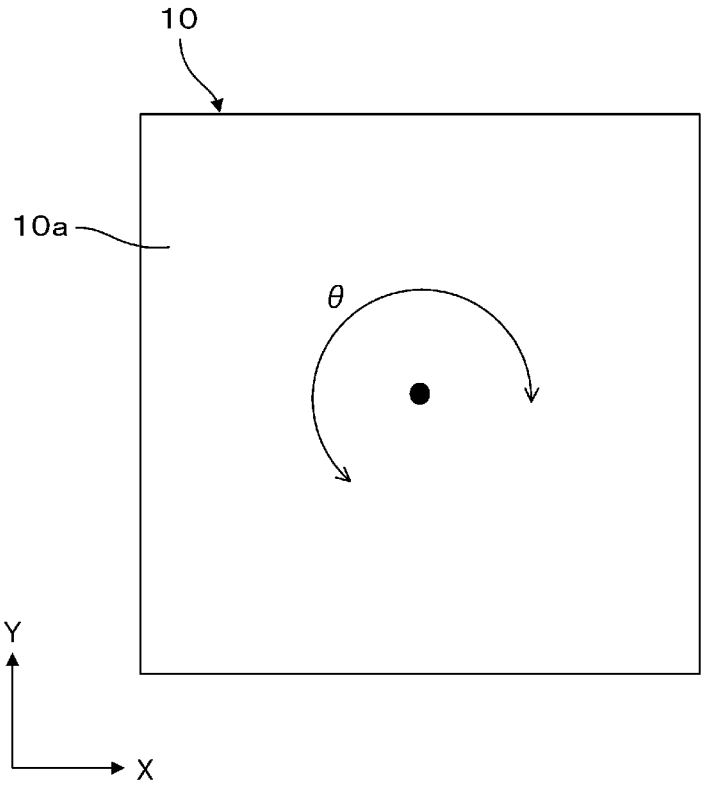
FIG. 2 is a plan view for explanation of the direction in which the stacking stage is moved by a correction mechanism.

The correction mechanism 20 is configured to move the stacking stage 10 in a direction parallel to the stacking surface 10*a* for the sake of eliminating or reducing misalignment of the objects 1 stacked in layers on the stacking surface 10*a* of the stacking stage 10. FIG. 2 is a plan view for explanation of the direction in which the stacking stage 10 is moved by the correction mechanism 20. The correction mechanism 20 can move the stacking stage 10 in the X axis direction, the Y axis direction, and the direction in which the stacking stage 10 rotates about its center, as illustrated in FIG. 2. The direction of rotation is herein denoted by θ.

As illustrated in FIG. 1, the correction mechanism 20 in the present embodiment is located on the opposite side from the stacking surface 10*a* of the stacking stage 10 and overlaps the stacking stage 10 or geometrically conforms to the stacking stage 10 when viewed in the direction perpendicular to the stacking surface 10*a*. The stacking stage 10 and the correction mechanism 20 are not in direct contact with each other, as illustrated in FIG. 1. The stacking stage 10 and the correction mechanism 20 may be arranged with an empty space therebetween or with another member therebetween.

The linear-motion mechanism 40 connects the stacking stage 10 and the correction mechanism 20 to each other. The linear-motion mechanism 40 gives the freedom of movement in the direction perpendicular to the stacking surface 10*a* of the stacking stage 10 and constrains the movement parallel to the stacking surface 10*a*. For example, the linear-motion mechanism 40 is composed of linear shafts. The stacking stage 10 and the correction mechanism 20 are connected to each other by the linear-motion mechanism 40 such that the stacking stage 10 can be moved independently of the correction mechanism 20 in the direction perpendicular to the stacking surface 10*a*.

The linear-motion mechanism 40 connecting the stacking stage 10 and the correction mechanism 20 to each other enables the correction mechanism 20 to move the stacking stage 10 in directions parallel to the stacking surface 10*a* with high accuracy. For example, the correction mechanism 20 includes what is called UVW stage. The UVW is movable in the X axis direction, the Y axis direction, and the 0 direction. The UVW stage and the stacking stage 10 are connected to each other by the linear-motion mechanism 40. When the UVW stage of the correction mechanism 20 shifts in the X axis direction, the stacking stage 10 shifts correspondingly in the X axis direction. When the UVW stage shifts in the Y axis direction, the stacking stage 10 shifts correspondingly in the Y axis direction. When the UVW stage shifts in the θ direction, the stacking stage 10 shifts correspondingly in the θ direction. In place of the UVW stage in the form of a single-stage structure, what is called XYθ may be included in the correction mechanism 20. The XYθ stage includes three stages that are movable in the X axis direction, the Y axis direction, and the θ axis direction, respectively.

The stacking apparatus 100 may include an elastic member 50, which connects the stacking stage 10 and the correction mechanism 20 to each other and exerts a force that brings the stacking stage 10 close to the correction mechanism 20. For example, the elastic member 50 is a spring. With the elastic member 50 being included in the stacking apparatus 100, the stacking stage 10 is pressed against an arm part 32 of the driving mechanism 30. The arm part 32 will be described later. The stacking stage 10 on the arm part 32 can thus be moved in a steady way in the direction perpendicular to the stacking surface 10*a*, as will be described later.

The driving mechanism 30 is configured to cause the stacking stage 10 to shift in the direction perpendicular to the stacking surface 10*a*. The driving mechanism 30 includes a main body part 31 as well as the arm part 32. The main body part 31 does not overlap the stacking stage 10 when viewed in the direction perpendicular to the stacking surface 10*a* of the stacking stage 10. The arm part 32 extends from the main body part 31 and between the stacking stage 10 and the correction mechanism 20 and supports the stacking stage 10. The arm part 32 is capable of movement in the direction perpendicular to the stacking surface 10*a*. As mentioned above, the main body part 31 of the driving mechanism 30 does not overlap the stacking stage 10. This means that the correction mechanism 20 does not bear the weight of the main body part 31. The driving mechanism 30 may include a motor 35 for moving the arm part 32 in the direction perpendicular to the stacking surface 10*a* of the stacking stage 10.

The main body part 31 of the driving mechanism 30 has a shape that is longer in the Z axis direction than in the other directions. With one end being attached to the main body part 31, the arm part 32 is movable in the Z axis direction along the main body part 31 that is longer in the Z axis direction than in the other directions. The other end of the arm part 32 is located between the stacking stage 10 and the correction mechanism 20.

The arm part 32 in the present embodiment may be connected to a base part 60 by a linear-motion mechanism 41. The base part 60 is not capable of being moved by the correction mechanism 20. For example, the linear-motion mechanism 41 is a linear shaft. A means by which the arm part 32 shifts along the main body part 31 in the Z axis direction is analogous to, for example, a ball screw including a screw shaft and a nut that is attached to the screw shaft and movable along the screw shaft. More specifically, the main body part 31 that is longer in the Z axis direction than in the other directions can be seen as analogous to the screw shaft of the ball screw, and the attached portion of the arm part 32 (i.e., the portion attached to the main body part 31) can be seen as analogous to the nut of the ball screw. The use of the means analogous to a ball screw requires the arm part 32 and the linear-motion mechanism 41 to be able to shift independently of the functioning of the correction mechanism 20, in which case the correction mechanism 20 is preferably not used to hold the arm part 32 and the linear-motion mechanism 41 in place. The motor 35 generates driving force, which causes the main body part 31 to rotate about its rotation axis parallel to the Z axis. The rotation causes the arm part 32 to shift in the Z axis direction. This does not limit how the arm part 32 shifts in the direction perpendicular to the stacking surface 10*a* of the stacking stage 10.

The driving mechanism 30 may further include a support plate 33 for supporting the stacking stage 10. The support plate 33 is attached to the arm part 32. The support plate 33 has a support surface 33*a*. The support plate 33 has a larger area of contact with the stacking stage 10 than the arm part 32 would have when supporting the stacking stage 10 without the support plate 33 therebetween. Thus, the stacking stage 10 held on the support plate 33 of the driving mechanism 30 is more stable. Accordingly, the stacking stage 10 can be moved in a steadier way in the direction perpendicular to the stacking surface 10*a* with the aid of the support plate 33.

Figure 3:
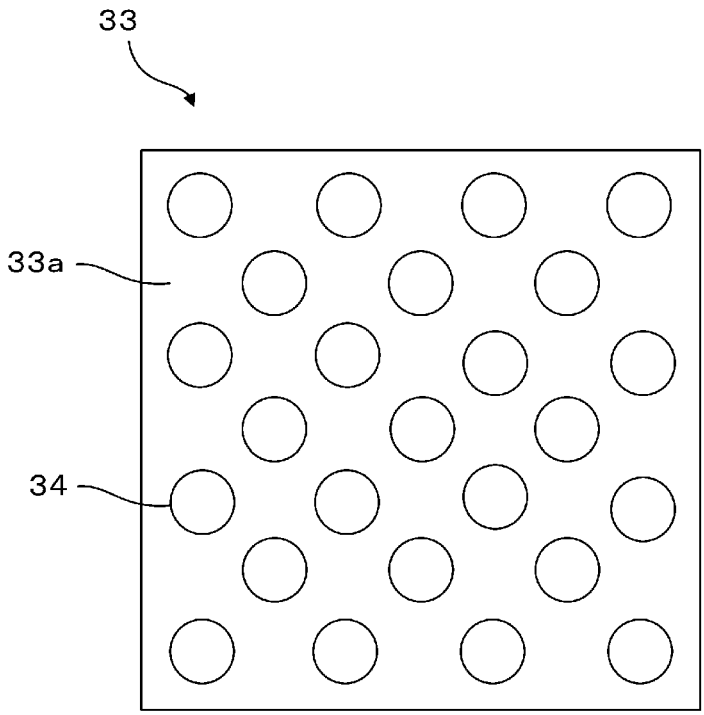
FIG. 3 is a schematic plan view of the structure of a support plate.

The support surface 33*a* of the support plate 33 is preferably a sliding surface so that the support plate 33 is capable of sliding along the stacking stage 10. FIG. 3 is a schematic plan view of the structure of the support plate 33. A slidable material is applied to the support surface 33*a* of the support plate 33. Referring to FIG. 3, slidable resin members 34 are arranged on the support surface 33*a* of the support plate 33. The slidable resin members 34 may be made of Teflon (registered trademark) or ultrahigh molecular weight polyethylene.

As mentioned above, the arm part 32 of the driving mechanism 30 is capable of movement in the direction perpendicular to the stacking surface 10*a* of the stacking stage 10. When the arm part 32 shifts in the direction perpendicular to the stacking surface 10*a*, the support plate 33 attached to the arm part 32 shifts in tandem with the arm part 32. Accordingly, the stacking stage 10 supported by the support plate 33 also shifts in the direction perpendicular to the stacking surface 10*a*. That is, the stacking stage 10 can be moved in the direction perpendicular to the stacking surface 10*a* while the arm part 32 of the driving mechanism 30 is moved in the direction perpendicular to the stacking surface 10*a*. The stacking stage 10 is supported by the arm part 32 extending from the main body part 31 and between the stacking stage 10 and the correction mechanism 20 such that the stacking stage 10 alone can be moved in the direction perpendicular to the stacking surface 10*a*. This means that the movement of the arm part 32 does not impart motion to the correction mechanism 20.

The driving mechanism 30 of the stacking apparatus 100 according to the present embodiment is configured to move the stacking stage 10 alone in the direction perpendicular to the stacking surface 10*a* and is thus more compact in size than would be the case if the driving mechanism 30 is configured to move the stacking stage 10 and the correction mechanism 20 at all once. More specifically, the motor 35 included in the driving mechanism 30 and configured to generate driving force for moving the arm part 32 and, by extension, for moving the stacking stage 10 is compact in size.

The main body part 31 of the driving mechanism 30 does not overlap the stacking stage 10 when viewed in the direction perpendicular to the stacking surface 10*a* of the stacking stage 10, in which case the degree of design flexibility is higher than would be the case if the main body part 31 overlaps the stacking stage 10.

As mentioned above, the driving mechanism 30 may include the support plate 33, and the support surface 33*a* of the support plate 33 is in slidable contact with the stacking stage 10. In this case, the correction mechanism 20 and the driving mechanism 30 can move the stacking stage 10 at the same time in the respective directions. In other words, in the case where the support surface 33*a* of the support plate 33 is in slidable contact with the stacking stage 10, the stacking stage 10 supported by the support plate 33 can be moved by the correction mechanism 20 in the direction parallel to the stacking surface 10*a*. That is, the correction mechanism 20 and the driving mechanism 30 can move the stacking stage 10 at the same time in the respective directions, namely, the direction parallel to the stacking surface 10*a* and the direction perpendicular to the stacking surface 10*a*. This feature provides an advantage in that the position of the stacking stage 10 can be corrected within a short time. This translates into the shortening of the time required to stack the objects 1 in layers on the stacking stage 10.

(Stacking System)

The following describes the configuration of a stacking system including the stacking apparatus 100 according to an embodiment. The stacking system is herein denoted by 200.

Figure 4:
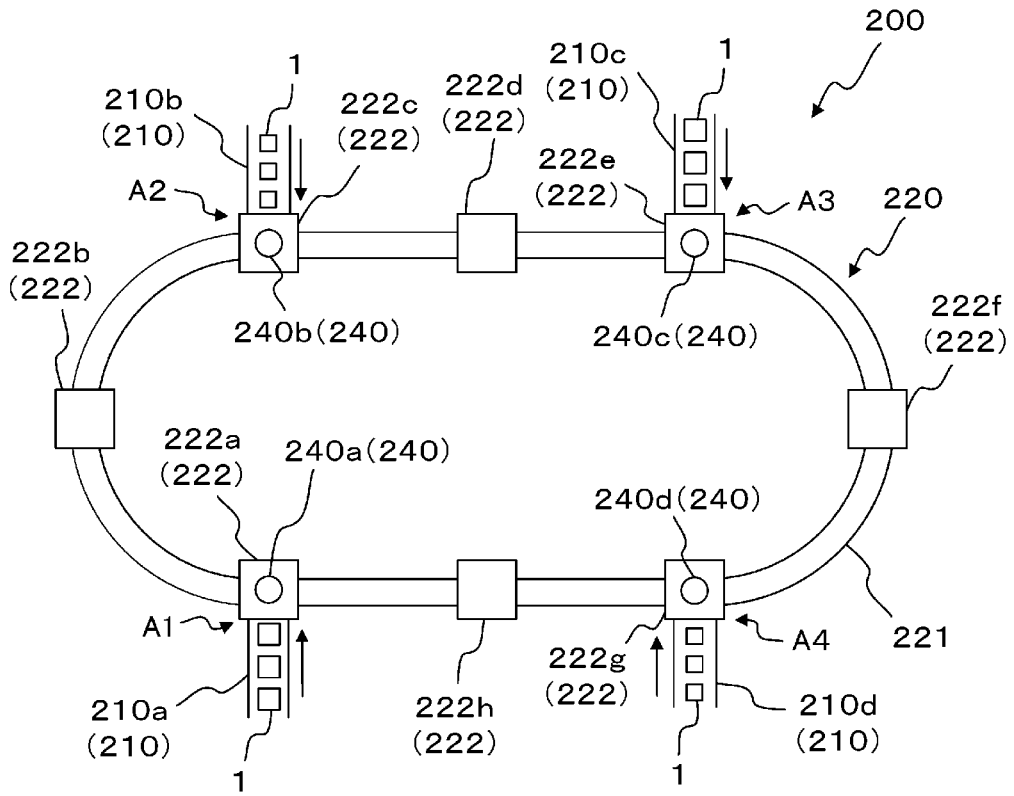
FIG. 4 is a schematic plan view of the structure of a stacking system including the stacking apparatus according to an embodiment.

FIG. 4 is a schematic plan view of the structure of the stacking system 200 including the stacking apparatus 100 according to an embodiment. The stacking system 200 includes feed mechanisms 210 and a movement mechanism 220. The stacking system 200 may include, in addition to the feed mechanisms 210 and the movement mechanism 220, a control unit configured to control the operation of these mechanisms. The stacking apparatus 100 is incorporated into the movement mechanism 220, which will be described later. The following describes an example in which the objects 1 are battery material sheets. However, it is not required that the objects 1 be battery material sheets.

The feed mechanisms 210 feed objects (the objects 1) to the respective feed points, which are denoted by A1 to A4. As the objects 1, objects of different kinds are fed to the feed points A1 to A4; that is, objects of each kind are fed to the corresponding one of the feed points. As the feed mechanisms 210 in the present embodiment, four feed mechanisms or, more specifically, a first feed mechanism 210*a*, a second feed mechanism 210*b*, a third feed mechanism 210*c*, and a fourth feed mechanism 210*d* are included in the system. However, the number of feed mechanisms 210 in the system is not limited to this value.

The first feed mechanism 210*a* feeds objects (the objects 1) to the first feed point A1; for example, the first feed mechanism 210*a* feeds resin films. The resin films are battery material sheets that serve as separators. The resin films are made of, for example, polyethylene. The first feed mechanism 210*a* in the present embodiment is a belt conveyor being essentially a belt for conveying objects. The first feed mechanism 210*a* conveys the objects 1 on the belt to feed them to the first feed point A1.

The second feed mechanism 210*b* feeds objects (the objects 1) to the second feed point A2; for example, the second feed mechanism 210*b* feeds first metal foil sheets.

The first metal foil sheets are battery material sheets and serve as positive electrodes or negative electrodes. The first metal foil sheets are made of, for example, aluminum. The second feed mechanism 210*b* in the present embodiment is a belt conveyor being essentially a belt for conveying objects. The second feed mechanism 210*b* conveys the objects 1 on the belt to feed them to the second feed point A2.

The third feed mechanism 210*c* feeds objects (the objects 1) to the third feed point A3; for example, the third feed mechanism 210*c* feeds resin films. The resin films are battery material sheets that serve as separators. The resin films are made of, for example, polyethylene. The first feed mechanism 210*a* and the third feed mechanism 210*c* may feed resin films of the same kind. Alternatively, the first feed mechanism 210*a* and the third feed mechanism 210*c* may feed resin films of different kinds. The third feed mechanism 210*c* in the present embodiment is a belt conveyor being essentially a belt for conveying objects. The third feed mechanism 210*c* conveys the objects 1 on the belt to feed them to the third feed point A3.

The fourth feed mechanism 210*d* feeds objects (the objects 1) to the fourth feed point A4; for example, the fourth feed mechanism 210*d* feeds second metal foil sheets. The second metal foil sheets are battery material sheets. The second metal foil sheets serve as negative electrodes when the first metal foil sheets serve as positive electrodes, and the second metal foil sheets serve as positive electrodes when the first metal foil sheets serve as negative electrodes. The second metal foil sheets are made of, for example, aluminum. The fourth feed mechanism 210*d* in the present embodiment is a belt conveyor being essentially a belt for conveying objects. The fourth feed mechanism 210*d* conveys the objects 1 on the belt to feed them to the fourth feed point A4.

It is not required that the first feed mechanism 210*a*, the second feed mechanism 210*b*, the third feed mechanism 210*c*, and the fourth feed mechanism 210*d* each be a belt conveyor. The feed mechanism each may be any other structure for conveying the objects 1 to feed them to the respective feed points.

Although the feed mechanisms 210 mentioned above convey discrete objects (the objects 1), the feed mechanisms 210 may be designed to convey a long-length object (the object 1). The object 1 that is a long-length object may be cut in pieces at the feed points A1 to A4. Although the objects 1 in the present embodiment are rectangular in shape, the objects 1 may have any other shape.

The movement mechanism 220 includes a stator 221 and movers 222, which constitute a linear motor. The stator 221 defines a predetermined track. The movers 222 are capable of movement between the feed points A1 to A4 along the predetermined track. Referring to FIG. 4, the track defined by the stator 221 in the present embodiment has an elliptical annular shape when viewed in plan. The track may have a shape other than an elliptical annular shape when viewed in plan.

The individual movers 222 in the present embodiment are hereinafter also referred to as a first mover 222*a*, a second mover 222*b*, a third mover 222*c*, a fourth mover 222*d*, a fifth mover 222*e*, a sixth mover 222*f*, a seventh mover 222*g*, and an eighth mover 222*h*, respectively. The movers 222*a* to 222*h* can be moved independently of each other. The movers 222*a* to 222*h* are included in the movement mechanism 220 so that the objects 1 can be conveyed and stacked in layers efficiently within a short time.

Figure 5:
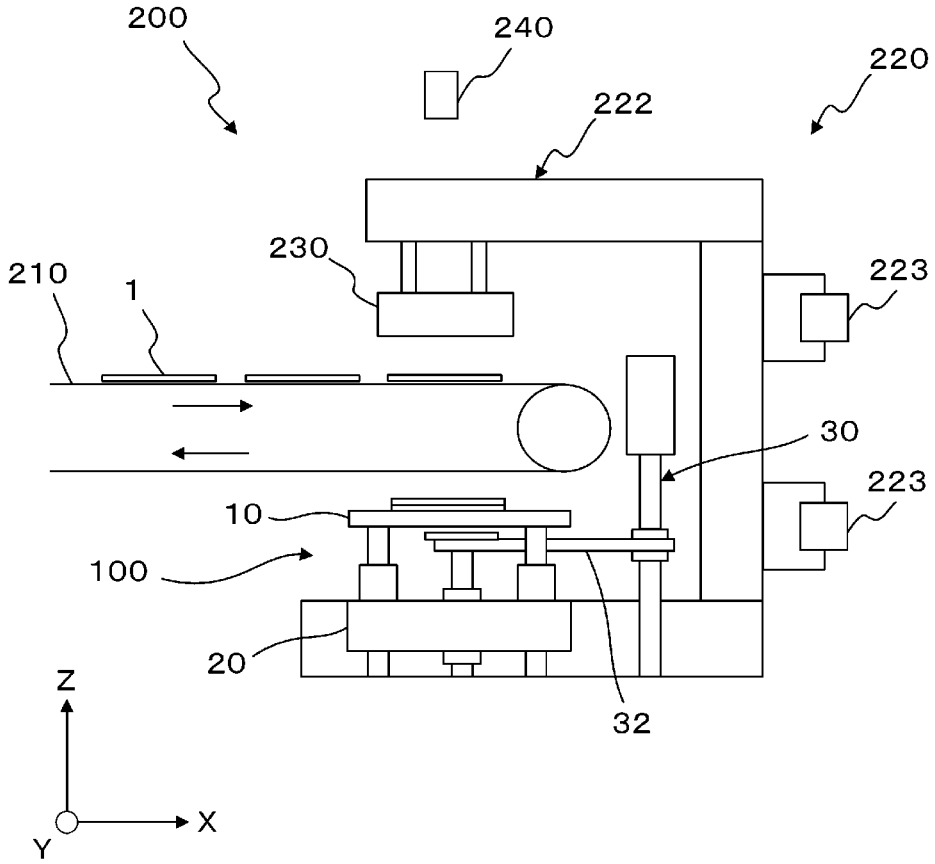
FIG. 5 is a schematic view of a mover of a movement mechanism, illustrating the structure of the mover viewed in the direction of a track defined by a stator.

FIG. 5 is a schematic view of one of the movers 222 included in the movement mechanism 220, illustrating the structure of the mover 222 viewed in the direction of the track defined by the stator 221. Referring to FIG. 5, the mover 222 includes the stacking apparatus 100 according to an embodiment and a holding part 230. The X axis in FIG. 5 indicates the direction in which the feed mechanism 210 conveys the objects 1. The Y axis in FIG. 5 indicates the direction of the movement of the mover 222 on the track. The Z axis direction is the vertical direction.

The holding part 230 holds the objects 1 conveyed by the feed mechanism 210. The holding part 230 is capable of movement in the Z axis direction. The holding part 230 in the present embodiment descends from above to the object 1. The holding part 230 then picks up and holds the object 1 by suction. The holding part 230 may hold the object 1 by a means other than suction.

While holding the object 1, the holding part 230 descends toward the stacking stage 10. As will be described later, the holding part 230 in the present embodiment descends over a fixed distance while the mover 222 is on the move along the track defined by the stator 221. The holding part 230 then stops sucking and releases the object 1 to place it on the stacking stage 10. The holding part 230 designed to descend over a fixed distance is structurally simpler than would be the case if the degree of descent of the holding part 230 is changed proportionately with the number of objects (the objects 1) that have already been stacked in layers on the stacking stage 10. The expression "place the object 1 on the stacking stage 10" may be herein used to describe a state in which the object 1 is superposed on the objects 1 that have already been stacked in layers on the stacking stage 10.

Before the holding part 230 places the object 1 on the stacking stage 10, the correction mechanism 20 compensates for misalignment by moving the stacking stage 10 in the direction parallel to the stacking surface 10*a*, and the driving mechanism 30 moves the stacking stage 10 in the Z axis direction proportionately with the number of objects (the objects 1) on the stacking stage 10. The procedure by which the correction mechanism 20 compensates for misalignment will be described in detail later.

Every time one object (the object 1) is placed on the stacking stage 10, the driving mechanism 30 causes the stacking stage 10 to descend over a distance equivalent to the thickness of the object concerned. Meanwhile, the holding part 230 holding the object 1 descends over a fixed distance before placing the object 1 on the stacking stage 10. These actions are repeated such that the objects 1 are stacked on top of one another in sequence on the stacking stage 10.

Referring to FIG. 5, the stator 221 defining the track includes two guide rails 223, and the mover 222 is attached to the guide rails 223 of the stator 221. The mover 222 is capable of movement along the guide rails 223. As illustrated in FIG. 5, the guide rails 223 of the stator 221 are located on the lateral side of the mover 222; that is, the guide rails 223 are not located vertically below the mover 222. If the guide rails 223 are located vertically below the mover 222, the mover 222 on the two guide rails would need to be controlled with consideration given to the difference in turning radius. The guide rails 223 on the lateral side of the mover 222 eliminates the need to take the difference in turning radius in consideration. This structure thus provides ease of control.

The stacking system 200 according to the present embodiment includes imaging apparatuses 240 to obtain visual representations of the objects 1 fed by the feed mechanisms 210. Each of the imaging apparatuses 240 is disposed vertically above the objects 1 at the corresponding one of the feed points A1 to A4. The imaging apparatuses 240 record images of the objects 1 fed by the feed mechanisms 210 and being stationary at the feed points A1 to A4.

The imaging apparatuses 240 record images of the objects 1 to determine the positions and orientations of the objects 1. In the case where the objects 1 are rectangular in shape, the positions and orientations of the objects 1 can be determined on the basis of the position of the corners of the objects 1 in the images recorded by the imaging apparatuses 240.

Although the mover 222 in FIG. 5 seems to overlap an optical path formed by the imaging apparatus 240 during imaging, the mover 222 has, for example, a cutout so that the imaging apparatus 240 can record an image of the object 1 at the feed point.

In the present embodiment, four feed points (the feed points A1 to A4) are provided for four different kinds of objects (the objects 1). Accordingly, four imaging apparatuses (the imaging apparatuses 240) are provided for the respective feed points (the feed points A1 to A4). Specifically, a first imaging apparatus 240*a* is disposed vertically above the first feed point A1, a second imaging apparatus 240*b* is disposed vertically above the second feed point A2, a third imaging apparatus 240*c* is disposed vertically above the third feed point A3, and a fourth imaging apparatus 240*d* is disposed vertically above the fourth feed point A4.

The correction mechanism 20 moves the stacking stage 10 in the direction parallel to the stacking surface 10*a* on the basis of the images being visual representations of the objects 1 and recorded by the imaging apparatuses 240. In this way, the correction mechanism 20 corrects the position of the stacking stage 10 so that the stacking stage 10 is properly positioned with respect to the objects 1. Accordingly, the objects 1 can be stacked in layers on the stacking stage 10 in such a way as to eliminate or reduce misalignment of the objects 1, which eventually constitute a multilayer body. Other approaches without the use of images of the objects 1 may be adopted as a means of correcting the position of the stacking stage 10 so that the stacking stage 10 is properly positioned with respect to the objects 1.

The following describes how the objects of four different kinds (the objects 1) are stacked on top of one another in sequence by the stacking system 200 including stacking apparatuses each being the stacking apparatus 100 according to an embodiment. Although the operation of only one of the eight movers 222 or, more specifically, the operation of the first mover 222*a* is described below, the other movers (the movers 222*b* to 222*h*) operate in the same way as the first mover 222*a* to stack the objects 1 in layers. Given that T is the time it takes for the first mover 222*a* to make one circuit along the track defined by the stator 221, the eighth mover 222*h*, the seventh mover 222*g*, the sixth mover 222*f*, the fifth mover 222*e*, the fourth mover 222*d*, the third mover 222*c*, and the second mover 222*b* operate in the same way as the first mover 222*a* after a delay of T/8, (2T)/8, (3T)/8, (4T)/8, (5T)/8, (6T)/8, and (7T)/8, respectively.

The following describes an example in which the stacking system 200 includes, in addition to the feed mechanisms 210 and the movement mechanism 220, a control unit configured to control the operation of these mechanisms.

(S1) The first feed mechanism 210*a* under the control of the control unit feeds a resin film (the object 1) to the first feed point A1, and the first mover 222*a* under the control of the control unit stops at the first feed point A1. The first imaging apparatus 240*a* under the control of the control unit records an image of the object 1 being stationary at the first feed point A1. After the first imaging apparatus 240*a* records an image of the object 1, the control unit causes the holding part 230 to descend and to hold the object 1 at the first feed point A1.

When the first mover 222*a* is standing still at the first feed point A1, the third mover 222*c*, the fifth mover 222*e*, and the seventh mover 222*g* are standing still at the second feed point A2, the third feed point A3, and the fourth feed point A4, respectively. As will be described later, the third mover 222*c*, the fifth mover 222*e*, and the seventh mover 222*g* each operate in the same way as the first mover 222*a* to place the objects 1 on the stacking stage 10 within a time period over which the respective holding parts 230 holding the objects 1 fed to the feed points A1 to A4 are on the move before stopping at the next feed point (one of the feed points A1 to A4).

When the first mover 222*a* is standing still at the first feed point A1, the second mover 222*b* is located between the first feed point A1 and the second feed point A2, the fourth mover 222*d* is located between the second feed point A2 and the third feed point A3, the sixth mover 222*f* is located between the third feed point A3 and the fourth feed point A4, and the eighth mover 222*h* is located between the fourth feed point A4 and the first feed point A1. As will be described later, the second mover 222*b*, the fourth mover 222*d*, the sixth mover 222*f*, and the eighth mover 222*h* each make positional corrections (correct the position of the stacking stage 10 so that the stacking stage 10 is properly positioned with respect to the object 1) while being on the move before stopping at the next feed point (one of the feed points A1 to A4).

(S2) The first mover 222*a* under the control of the control unit then shifts from the first feed point A1 to the second feed point A2 while staying on the track. Within a time period over which the first mover 222*a* is on the move from the first feed point A1 before stopping at the second feed point A2, the correction mechanism 20 and the driving mechanism 30 move the stacking stage 10 in the respective directions, namely, the direction parallel to the stacking surface 10*a* and the direction perpendicular to the stacking surface 10*a*. More specifically, the correction mechanism 20 moves the stacking stage 10 in the direction parallel to the stacking surface 10*a* on the basis of the image being a visual representation of the object 1 and recorded by the first imaging apparatus 240*a*. In this way, the correction mechanism 20 corrects the position of the stacking stage 10 so that the stacking stage 10 is properly positioned with respect to the object 1 fed to the first feed point A1. The driving mechanism 30 moves the stacking stage 10 in the direction perpendicular to the stacking surface 10*a* proportionately with the number of objects (the objects 1) on the stacking stage 10. The correction mechanism 20 and the driving mechanism 30 may move the stacking stage 10 simultaneously or at different times.

Subsequently, the control unit causes the holding part 230 to descend over a fixed distance and then causes the holding part 230 to stop sucking and to release the object 1. As a result, the object 1 is placed on the stacking stage 10.

As mentioned above, the first mover 222*a* under the control of the control unit shifts from the first feed point A1 to the second feed point A2. In the meanwhile, the third mover 222*c* under the control of the control unit shifts from the second feed point A2 to the third feed point A3, the fifth mover 222*e* under the control of the control unit shifts from the third feed point A3 to the fourth feed point A4, and the seventh mover 222*g* under the control of the control unit shifts from the fourth feed point A4 to the first feed point A1.

The control unit also causes the second mover 222*b*, the fourth mover 222*d*, the sixth mover 222*f*, and the eighth mover 222*h* to shift.

(S3) Subsequently, the second feed mechanism 210*b* under the control of the control unit feeds a first metal foil sheet (the object 1) to the second feed point A2, and the first mover 222*a* under the control of the control unit stops at the second feed point A2. The second imaging apparatus 240*b* under the control of the control unit records an image of the object 1 being stationary at the second feed point A2. After the second imaging apparatus 240*b* records an image of the object 1, the control unit causes the holding part 230 to descend and to hold the object 1 at the second feed point A2.

When the first mover 222*a* is standing still at the second feed point A2, the third mover 222*c*, the fifth mover 222*e*, and the seventh mover 222*g* are standing still at the third feed point A3, the fourth feed point A4, and the first feed point A1, respectively. In the meanwhile, the second mover 222*b* is located between the second feed point A2 and the third feed point A3, the fourth mover 222*d* is located between the third feed point A3 and the fourth feed point A4, the sixth mover 222*f* is located between the fourth feed point A4 and the first feed point A1, and the eighth mover 222*h* is located between the first feed point A1 and the second feed point A2.

(S4) The first mover 222*a* under the control of the control unit then shifts from the second feed point A2 to the third feed point A3 while staying on the track. Within a time period over which the first mover 222*a* is on the move from the second feed point A2 before stopping at the third feed point A3, the correction mechanism 20 and the driving mechanism 30 move the stacking stage 10 in the respective directions, namely, the direction parallel to the stacking surface 10*a* and the direction perpendicular to the stacking surface 10*a*. More specifically, the correction mechanism 20 moves the stacking stage 10 in the direction parallel to the stacking surface 10*a* on the basis of the image being a visual representation of the object 1 and recorded by the second imaging apparatus 240*b*. In this way, the correction mechanism 20 corrects the position of the stacking stage 10 so that the stacking stage 10 is properly positioned with respect to the object 1 fed to the second feed point A2.

The driving mechanism 30 moves the stacking stage 10 in the direction perpendicular to the stacking surface 10*a* proportionately with the number of objects (the objects 1) on the stacking stage 10. More specifically, the driving mechanism 30 causes the stacking stage 10 to descend over a distance equivalent to the thickness of the object 1 that is newly placed on the stacking stage 10. The procedure by which the object 1 is placed on the stacking stage 10 subsequent to the positional corrections of the stacking stage 10 is as already mentioned above in relation to the object 1 fed to the first feed point A1.

As mentioned above, the first mover 222*a* under the control of the control unit shifts from the second feed point A2 to the third feed point A3. In the meanwhile, the third mover 222*c* under the control of the control unit shifts from the third feed point A3 to the fourth feed point A4, the fifth mover 222*e* under the control of the control unit shifts from the fourth feed point A4 to the first feed point A1, and the seventh mover 222*g* under the control of the control unit shifts from the first feed point A1 to the second feed point A2. The control unit also causes the second mover 222*b*, the fourth mover 222*d*, the sixth mover 222*f*, and the eighth mover 222*h* to shift.

(S5) Subsequently, the third feed mechanism 210*c* under the control of the control unit feeds a resin film (the object 1) to the third feed point A3, and the first mover 222*a* under the control of the control unit stops at the third feed point A3. The third imaging apparatus 240*c* under the control of the control unit records an image of the object 1 being stationary at the third feed point A3. After the third imaging apparatus 240*c* records an image of the object 1, the control unit causes the holding part 230 to descend and to hold the object 1 at the third feed point A3.

When the first mover 222*a* is standing still at the third feed point A3, the third mover 222*c*, the fifth mover 222*e*, and the seventh mover 222*g* are standing still at the fourth feed point A4, the first feed point A1, and the second feed point A2, respectively. In the meanwhile, the second mover 222*b* is located between the third feed point A3 and the fourth feed point A4, the fourth mover 222*d* is located between the fourth feed point A4 and the first feed point A1, the sixth mover 222*f* is located between the first feed point A1 and the second feed point A2, and the eighth mover 222*h* is located between the second feed point A2 and the third feed point A3.

(S6) The first mover 222*a* under the control of the control unit then shifts from the third feed point A3 to the fourth feed point A4 while staying on the track. Within a time period over which the first mover 222*a* is on the move from the third feed point A3 before stopping at the fourth feed point A4, the correction mechanism 20 and the driving mechanism 30 move the stacking stage 10 in the respective directions, namely, the direction parallel to the stacking surface 10*a* and the direction perpendicular to the stacking surface 10*a*. More specifically, the correction mechanism 20 moves the stacking stage 10 in the direction parallel to the stacking surface 10*a* on the basis of the image being a visual representation of the object 1 and recorded by the third imaging apparatus 240*c*. In this way, the correction mechanism 20 corrects the position of the stacking stage 10 so that the stacking stage 10 is properly positioned with respect to the object 1 fed to the third feed point A3. The driving mechanism 30 moves the stacking stage 10 in the direction perpendicular to the stacking surface 10*a* proportionately with the number of objects (the objects 1) on the stacking stage 10. More specifically, the driving mechanism 30 causes the stacking stage 10 to descend over a distance equivalent to the thickness of the object 1 that is newly placed on the stacking stage 10. The procedure by which the object 1 is placed on the stacking stage 10 subsequent to the positional corrections of the stacking stage 10 is as already mentioned above in relation to the object 1 fed to the first feed point A1.

As mentioned above, the first mover 222*a* under the control of the control unit shifts from the third feed point A3 to the fourth feed point A4. In the meanwhile, the third mover 222*c* under the control of the control unit shifts from the fourth feed point A4 to the first feed point A1, the fifth mover 222*e* under the control of the control unit shifts from the first feed point A1 to the second feed point A2, and the seventh mover 222*g* under the control of the control unit shifts from the second feed point A2 to the third feed point A3. The control unit also causes the second mover 222*b*, the fourth mover 222*d*, the sixth mover 222*f*, and the eighth mover 222*h* to shift.

(S7) Subsequently, the fourth feed mechanism 210*d* under the control of the control unit feeds a second metal foil sheet (the object 1) to the fourth feed point A4, and the first mover 222*a* under the control of the control unit stops at the fourth feed point A4. The fourth imaging apparatus 240*d* under the control of the control unit records an image of the object 1 being stationary at the fourth feed point A4. After the fourth imaging apparatus 240*d* records an image of the object 1, the control unit causes the holding part 230 to descend and to hold the object 1 at the fourth feed point A4.

When the first mover 222*a* is standing still at the fourth feed point A4, the third mover 222*c*, the fifth mover 222*e*, and the seventh mover 222*g* are standing still at the first feed point A1, the second feed point A2, and the third feed point A3, respectively. In the meanwhile, the second mover 222*b* is located between the fourth feed point A4 and the first feed point A1, the fourth mover 222*d* is located between the first feed point A1 and the second feed point A2, the sixth mover 222*f* is located between the second feed point A2 and the third feed point A3, and the eighth mover 222*h* is located between the third feed point A3 and the fourth feed point A4.

(S8) The first mover 222*a* under the control of the control unit then shifts from the fourth feed point A4 to the first feed point A1 while staying on the track. Within a time period over which the first mover 222*a* is on the move from the fourth feed point A4 before stopping at the first feed point A1, the correction mechanism 20 and the driving mechanism 30 move the stacking stage 10 in the respective directions, namely, the direction parallel to the stacking surface 10*a* and the direction perpendicular to the stacking surface 10*a*. More specifically, the correction mechanism 20 moves the stacking stage 10 in the direction parallel to the stacking surface 10*a* on the basis of the image being a visual representation of the object 1 and recorded by the fourth imaging apparatus 240*d*. In this way, the correction mechanism 20 corrects the position of the stacking stage 10 so that the stacking stage 10 is properly positioned with respect to the object 1 fed to the fourth feed point A4.

The driving mechanism 30 moves the stacking stage 10 in the direction perpendicular to the stacking surface 10*a* proportionately with the number of objects (the objects 1) on the stacking stage 10. More specifically, the driving mechanism 30 causes the stacking stage 10 to descend over a distance equivalent to the thickness of the object 1 that is newly placed on the stacking stage 10. The procedure by which the object 1 is placed on the stacking stage 10 subsequent to the positional corrections of the stacking stage 10 is as already mentioned above in relation to the object 1 fed to the first feed point A1.

As mentioned above, the first mover 222*a* under the control of the control unit shifts from the fourth feed point A4 to the first feed point A1. In the meanwhile, the third mover 222*c* under the control of the control unit shifts from the first feed point A1 to the second feed point A2, the fifth mover 222*e* under the control of the control unit shifts from the second feed point A2 to the third feed point A3, and the seventh mover 222*g* under the control of the control unit shifts from the third feed point A3 to the fourth feed point A4. The control unit also causes the second mover 222*b*, the fourth mover 222*d*, the sixth mover 222*f*, and the eighth mover 222*h* to shift.

A resin film, a first metal foil sheet, another resin film, and a second metal foil sheet are stacked in sequence by the procedure including the steps (S1) to (S8) described above such that a semifinished product being a set of objects of four different kinds (the objects 1) is obtained. Then, the steps (S1) to (S8) are repeated multiple times so that a predetermined sets are stacked in layers. The resultant product is a multilayer body including positive electrodes and negative electrodes that are arranged alternatingly with each resin film serving as a separator between a positive electrode and a negative electrode. The multilayer body finds use as, for example, a component of a battery pack.

Each of the stacking apparatuses included in the stacking system 200 is the stacking apparatus 100 according to an embodiment The movers 222 included in the movement mechanism 220 can thus be compact in size. This yields a reduction in the force required to move the movers 222. Furthermore, the objects 1 can be stacked in layers with high accuracy. To put it the other way around, the movers 222 would be large in size and would be in need of application of a strong force to shift from one place to another if the stacking system 200 includes conventional stacking apparatuses each being larger than the stacking apparatus 100 according to an embodiment. Each mover 222 is alternately set in motion and comes to rest. If large-sized stacking apparatuses are included in the stacking system 200, each mover 222 would have more inertia and is thus more likely to shake such that the accuracy in stacking the objects 1 would be impaired. As mentioned above, the stacking apparatus 100 according to an embodiment is compact in size, in which case the mover 222 is less likely to shake such that the objects 1 can be stacked in layers with high accuracy.

It should be noted that the present disclosure is not limited to the embodiment above and various applications and alterations are possible within the scope of the present disclosure.

For example, it is not required that the objects 1 be the battery material sheets. In a case where conductor layers in sheet form and insulating layers in sheet form are used as the objects 1 of different kinds and stacked alternatingly in the manner described above, a multilayer substrate is obtained. The conductor layers are made of, for example, copper, silver, an alloy containing copper, an alloy containing silver, or Sn—Ag solder. The insulating layers are made of thermoplastic resin, such as liquid crystal polymer, polyether either ketone, polyetherimide, or polyimide, or are made of thermosetting resin, such as epoxy resin or unsaturated polyester.

The holding part 230 in the embodiment above descends to come close to the feed mechanism 210 so that the holding part 230 can hold the object 1. In some embodiments, however, the feed mechanism 210 ascends to come close to the holding part 230 so that the holding part 230 can hold the object 1.

The stacking apparatus and the stacking system in the present application are as follows.

<1> A stacking apparatus including a stacking stage having a stacking surface on which a plurality of objects are to be stacked in layers; a correction mechanism configured to move the stacking stage in a direction parallel to the stacking surface; a driving mechanism configured to move the stacking stage in a direction perpendicular to the stacking surface; and a linear-motion mechanism that connects the stacking stage and the correction mechanism to each other, the linear-motion mechanism giving freedom of movement in the direction perpendicular to the stacking surface and constraining movement in the direction parallel to the stacking surface. The driving mechanism includes a main body part that does not overlap the stacking stage when viewed in the direction perpendicular to the stacking surface, and an arm part extending from the main body part and between the stacking stage and the correction mechanism and supporting the stacking stage, the arm part being capable of movement in the direction perpendicular to the stacking surface.

<2> The stacking apparatus according to <1>, wherein the correction mechanism is located on an opposite side from the stacking surface of the stacking stage, and the correction mechanism overlaps the stacking stage or geometrically conforms to the stacking stage when viewed in the direction perpendicular to the stacking surface.

<3> The stacking apparatus according to <1> or <2>, wherein the linear-motion mechanism is a linear shaft.

<4> The stacking apparatus according to any one of <1> to <3>, wherein the driving mechanism further includes a support plate for supporting the stacking stage, and the support plate is attached to the arm part.

<5> The stacking apparatus according to <4>, wherein the support plate has a support surface that is in slidable contact with the stacking stage.

<6> The stacking apparatus according to any one of <1> to <5>, further comprising an elastic member that connects the stacking stage and the correction mechanism to each other and exerts a force that brings the stacking stage close to the correction mechanism.

<7> A stacking system comprising a plurality of feed mechanisms provided for a plurality of feed points, each of the plurality of feed mechanisms being configured to feed the plurality of objects to a corresponding one of the plurality of feed points; and a movement mechanism including a stator and a mover that constitute a linear motor, the stator defining a predetermined track, the mover being capable of movement between the plurality of feed points along the predetermined tack, the mover including the stacking apparatus according to any one of <1> to <6>.

<8> The stacking system according to <7>, wherein the movement mechanism includes a plurality of the movers.

What is claimed is:

1. A stacking apparatus comprising:

a stacking stage having a stacking surface on which a plurality of objects are to be stacked in layers;

a correction mechanism configured to move the stacking stage in a direction parallel to the stacking surface;

a driving mechanism configured to move the stacking stage in a direction perpendicular to the stacking surface; and a linear-motion mechanism that connects the stacking stage and the correction mechanism to each other, the linear-motion mechanism is configured to give freedom of movement in the direction perpendicular to the stacking surface and to constrain movement in the direction parallel to the stacking surface, wherein the driving mechanism includes a main body part that does not overlap the stacking stage when viewed in the direction perpendicular to the stacking surface, and an arm part extending from the main body part and between the stacking stage and the correction mechanism and supporting the stacking stage, the arm part being configured to move in the direction perpendicular to the stacking surface.

2. The stacking apparatus according to claim 1, wherein the correction mechanism is on an opposite side from the stacking surface of the stacking stage, and the correction mechanism overlaps the stacking stage or geometrically conforms to the stacking stage when viewed in the direction perpendicular to the stacking surface.

3. The stacking apparatus according to claim 2, wherein the linear-motion mechanism includes a linear shaft.

4. The stacking apparatus according to claim 3, wherein the driving mechanism further includes a support plate configured to support the stacking stage, and the support plate is attached to the arm part.

5. The stacking apparatus according to claim 2, wherein the driving mechanism further includes a support plate configured to support the stacking stage, and the support plate is attached to the arm part.

6. The stacking apparatus according to claim 2, further comprising:

an elastic member that connects the stacking stage and the correction mechanism to each other and exerts a force that brings the stacking stage close to the correction mechanism.

7. A stacking system comprising:

a plurality of feed mechanisms for a plurality of feed points, each of the plurality of feed mechanisms being configured to feed the plurality of objects to a corresponding one of the plurality of feed points; and a movement mechanism including a stator and at least one mover that configure a linear motor, the stator defining a predetermined track, the mover being configured to move between the plurality of feed points along the predetermined track, and the mover including the stacking apparatus according to claim 2.

8. The stacking apparatus according to claim 1, wherein the linear-motion mechanism includes a linear shaft.

9. The stacking apparatus according to claim 8, wherein the driving mechanism further includes a support plate configured to support the stacking stage, and the support plate is attached to the arm part.

10. The stacking apparatus according to claim 8, further comprising:

an elastic member that connects the stacking stage and the correction mechanism to each other and exerts a force that brings the stacking stage close to the correction mechanism.

11. A stacking system comprising:

a plurality of feed mechanisms for a plurality of feed points, each of the plurality of feed mechanisms being configured to feed the plurality of objects to a corresponding one of the plurality of feed points; and a movement mechanism including a stator and at least one mover that configure a linear motor, the stator defining a predetermined track, the mover being configured to move between the plurality of feed points along the predetermined track, and the mover including the stacking apparatus according to claim 8.

12. The stacking apparatus according to claim 1, further comprising:

an elastic member that connects the stacking stage and the correction mechanism to each other and exerts a force that brings the stacking stage close to the correction mechanism, wherein the driving mechanism further includes a support plate configured to support the stacking stage, and the support plate is attached to the arm part.

13. The stacking apparatus according to claim 12, wherein the support plate has a support surface that is in slidable contact with the stacking stage.

14. The stacking apparatus according to claim 13, further comprising:

an elastic member that connects the stacking stage and the correction mechanism to each other and exerts a force that brings the stacking stage close to the correction mechanism.

15. The stacking apparatus according to claim 12, further comprising:

an elastic member that connects the stacking stage and the correction mechanism to each other and exerts a force that brings the stacking stage close to the correction mechanism.

16. A stacking system comprising:

a plurality of feed mechanisms for a plurality of feed points, each of the plurality of feed mechanisms being configured to feed the plurality of objects to a corresponding one of the plurality of feed points; and a movement mechanism including a stator and at least one mover that configure a linear motor, the stator defining a predetermined track, the mover being configured to move between the plurality of feed points along the predetermined track, and the mover including the stacking apparatus according to claim 12.

17. A stacking system comprising:

a plurality of feed mechanisms for a plurality of feed points, each of the plurality of feed mechanisms being configured to feed the plurality of objects to a corresponding one of the plurality of feed points; and a movement mechanism including a stator and at least one mover that configure a linear motor, the stator defining a predetermined track, the mover being configured to move between the plurality of feed points along the predetermined track, and the mover including the stacking apparatus according to claim 1.

18. The stacking system according to claim 17, wherein the movement mechanism includes a plurality of the movers.

19. The stacking apparatus according to claim 1, wherein a portion of the arm part overlaps the stacking stage when viewed in the direction perpendicular to the stacking surface, and another portion of the arm part does not overlap the stacking stage when viewed in the direction perpendicular to the stacking surface.

20. The stacking apparatus according to claim 1, wherein movement of the arm part in the direction perpendicular to the stacking surface is limited by movement of the linear-motion mechanism.

* * * * *